US006580780B1

(12) United States Patent
Miller

(10) Patent No.: US 6,580,780 B1
(45) Date of Patent: Jun. 17, 2003

(54) COOLING SYSTEM FOR STATIONARY ANODE X-RAY TUBES

(75) Inventor: Robert S. Miller, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/656,931

(22) Filed: Sep. 7, 2000

(51) Int. Cl.[7] ..... H01J 35/12
(52) U.S. Cl. ..... 378/141; 378/130
(58) Field of Search ..... 378/129, 130, 378/141, 127

(56) References Cited

U.S. PATENT DOCUMENTS

| | | | | | |
|---|---|---|---|---|---|
| 3,694,685 | A | * | 9/1972 | Houston | 313/60 |
| 4,115,697 | A | | 9/1978 | Hounsfield et al. | 250/445 T |
| 4,455,504 | A | * | 6/1984 | Iversen | 313/30 |
| 4,622,687 | A | | 11/1986 | Whitaker et al. | 378/130 |
| 4,709,559 | A | | 12/1987 | Dotzauer et al. | 62/499 |
| 4,928,296 | A | * | 5/1990 | Kadambi | 378/141 |
| 5,018,181 | A | | 5/1991 | Iversen et al. | 378/144 |
| 5,541,975 | A | | 7/1996 | Anderson et al. | 378/130 |
| 5,689,542 | A | | 11/1997 | Lavering et al. | 378/142 |
| 5,737,387 | A | | 4/1998 | Smither | 378/130 |
| 6,002,745 | A | | 12/1999 | Miller et al. | 378/128 |
| 6,074,092 | A | | 6/2000 | Andrews | 378/200 |
| 6,115,454 | A | | 9/2000 | Andrews et al. | 378/140 |
| 6,125,169 | A | | 9/2000 | Wandke et al. | 378/143 |
| 6,249,569 | B1 | * | 6/2001 | Price et al. | 378/130 |
| 6,252,934 | B1 | * | 6/2001 | Scott et al. | 378/130 |

* cited by examiner

*Primary Examiner*—Drew A. Dunn
*Assistant Examiner*—Jurie Yun
(74) *Attorney, Agent, or Firm*—Workman, Nydegger & Seeley

(57) ABSTRACT

"A cooling disk to transfer heat from an anode to a circulated coolant. The cooling disk includes an annular body that defines an aperture and includes extended surfaces. The cooling disk resides in a fluid passageway defined by the anode, and contacts the anode so as to transfer heat from the anode to a coolant circulated through the fluid passageway by an external cooling unit. The coolant passes through a coolant supply passageway which includes a converging portion that serves to accelerate the coolant as it exits the coolant supply passageway. The accelerated coolant passes through the aperture and contacts a flow diverter disposed in the fluid passageway, as well as the extended surfaces of the cooling disk, so as to remove heat therefrom. The flow diverter transmits heat from the anode to the coolant. The coolant enters the coolant return passageway and returns to the external cooling unit."

55 Claims, 2 Drawing Sheets

COOLING SYSTEM FOR STATIONARY ANODE X-RAY TUBES

BACKGROUND OF THE INVENTION

1. The Field of the Invention

The present invention relates generally to x-ray tube devices. In particular, embodiments of the present invention relate to a cooling system for stationary anode x-ray tubes that employs extended surfaces to increase the rate of heat transfer from the x-ray tube so as to significantly reduce heat-induced damage within the x-ray tube structure and thereby extend the operating life of the device and permit operation of the x-ray tube device at relatively higher power settings than would otherwise be possible.

2. Prior State of the Art

X-ray producing devices are extremely valuable tools that are used in a wide variety of applications, both industrial and medical. Such equipment is commonly used in applications such as diagnostic and therapeutic radiology, semiconductor manufacture and fabrication, and materials testing. While used in a number of different applications, the basic operation of x-ray tubes is similar. In general, x-rays, or x-ray radiation, are produced when electrons are produced, accelerated, and then impinged upon a material of a particular composition.

Regardless of the application in which they are employed, these devices typically include a number of common elements including a cathode, or electron source, and an anode situated within an evacuated enclosure in a spaced apart arrangement. The anode includes a target surface oriented to receive electrons emitted by the cathode. In operation, an electric current applied to a filament portion of the cathode causes electrons to be emitted from the filament by thermionic emission. The electrons thus emitted then accelerate towards a target surface of the anode under the influence of an electric potential applied between the cathode and the anode. Upon approaching and striking the anode target surface, many of the electrons either emit, or cause the anode to emit, electromagnetic radiation of very high frequency, i.e., x-rays. The specific frequency of the x-rays produced depends in large part on the type of material used to form the anode target surface. Anode target surface materials with high atomic numbers ("Z" numbers) are typically employed. The x-rays are then collimated so that they exit the x-ray tube through a window in the tube, and enter the x-ray subject. As is well known, the x-rays can be used for therapeutic treatment, x-ray medical diagnostic examination, or material analysis procedures.

As discussed above, some of the electrons that impact the anode target surface convert a substantial portion of their kinetic energy to x-rays. Many electrons, however, do not produce x-rays as a result of their interaction with the anode target surface, but instead impart their kinetic energy to the anode and other x-ray tube structures in the form of heat. As a consequence of their substantial kinetic energy, the heat produced by these electrons is significant. Still other electrons simply rebound from the target surface and strike other "non target" surfaces within the x-ray tube. These are often referred to as "backscatter" electrons. These backscatter electrons retain a significant amount of kinetic energy after rebounding, and when they impact these other non-target surfaces, heat is generated within the x-ray device. The heat generated as a consequence of electron impacts on the target surface and other x-ray device structures must be reliably and continuously removed. If left unchecked, it can ultimately damage the x-ray tube and shorten its operational life.

Some x-ray generating devices at least partially alleviate this heat problem by employing an anode that continuously rotates within the device. This rotation distributes the heat over a larger area of the anode, allowing for more efficient dispersal of heat in the x-ray tube and reducing the chances of heat damage to the device. However, some applications such as x-ray fluorescence and spectrometry in sample analysis, and product and process control in the metals and cement industries, are best performed using stationary anode x-ray generating devices. Thus, alternative approaches to cooling have been developed for use with these types of devices.

One such approach involves the use of a cooling fluid circulated within the x-ray device. An example of this approach involves circulating a cooling fluid through a passageway formed within the interior of the anode so as to remove heat conducted to the anode from the anode target surface. This process is sometimes referred to as "impinging flow heat transfer" because at least a portion of the coolant flow is caused to impinge upon, or impact, at least one of the surfaces or structures of the x-ray tube from which heat is to be removed. This approach has proven problematic in some instances however, primarily due to the cooling fluids typically employed.

A variety of cooling fluids have been used in such a stationary anode x-ray generating device cooling system. Due to the structural and operational characteristics of the x-ray device, the cooling fluid employed must possess certain characteristics. For example, the cooling fluid must have an acceptable thermal efficiency, i.e., be capable of effectively absorbing and removing the significant heat produced during operation of the x-ray device. Furthermore, the high electric potential between the cathode and the anode necessitates the use of a cooling fluid that is electrically non-conductive, or "dielectric."

Various dielectric coolants have been employed in the context of stationary anode x-ray devices. For example, deionized water has been found to be an acceptable cooling fluid in some stationary anode x-ray generating devices because of its efficient heat absorption capabilities and non-conductivity. However, deionized water must be constantly monitored and processed to ensure that it retains its dielectric property. Such monitoring and processing increases the cost and complexity of the x-ray device cooling system. In view of the disadvantages of deionized water as a cooling fluid, alternative fluids have been utilized. For example, dielectric oils are commonly employed in stationary anode x-ray generating devices because of their non-conductivity. Further, they are somewhat more desirable than deionized water in that they do not require maintenance or processing to maintain their nonconductive properties.

While dielectric fluids are generally desirable cooling media for x-ray device applications due to their electrical properties, they have proven unable to adequately cool many stationary anode x-ray devices. Thus, a need exists for improving the rate of heat transfer that is currently achieved in typical stationary anode x-ray tubes.

SUMMARY AND OBJECTS OF THE INVENTION

The present invention has been developed in response to the current state of the art, and in particular, in response to these and other problems and needs that have not been fully or adequately solved by currently available stationary anode cooling systems. Thus it is an overall object of embodiments of the present invention to resolve at least the aforementioned problems and shortcomings in the art by providing an x-ray tube cooling system that facilitates a relative increase in the rate at which heat is transferred from x-ray tubes. Embodiments of the present invention are especially well-suited for use in the context of stationary anode x-ray tubes. However, it will be appreciated that the features and advantages of the present invention may find useful application in other types of x-ray devices as well Briefly summarized, the foregoing objects and advantages are provided by an x-ray tube cooling system employing a surface area augmentation structure having a plurality of extended surfaces configured to transfer heat from the stationary anode and other x-ray tube structures to a liquid coolant circulating through the stationary anode.

In a preferred embodiment, the surface area augmentation structure comprises a cooling disk having an annular body defining an aperture, and a plurality of cooling fins disposed about the aperture at regular intervals and extending from the annular body. Preferably, the cooling fins are integral with the annular body. The cooling disk is disposed within a fluid passageway partially defined by the anode so that the cooling disk is in substantial contact with both the anode and coolant flowing through the fluid passageway.

In operation, an external cooling unit produces a flow of coolant that is continuously circulated through coolant supply and coolant return passageways. The coolant leaving the external cooling unit is introduced into the anode by way of a coolant injection assembly. The coolant injection assembly includes a nozzle at the downstream end so that coolant exiting the coolant supply passageway of the coolant injection assembly is caused to accelerate as it exits the coolant supply passageway. After exiting the coolant supply passageway, the rapidly moving coolant flows towards the cooling disk disposed proximate to the nozzle. Upon reaching the cooling disk, the coolant passes through the aperture defined by the annular body of the cooling disk. The cooling fluid then exits the cooling disk aperture and impinges upon a flow diverter disposed inside the anode opposite the cooling disk.

Preferably, the flow diverter is integral with the anode. The flow diverter serves both to direct the coolant flow exiting the disk into the coolant return passageway and to transmit heat from at least the anode to the coolant passing through the coolant disk.

After being redirected by the flow diverter, the cooling fluid then passes between the fins of the cooling disk and, by so doing, absorbs heat conducted to the cooling disk from the anode. The cooling fluid is then conveyed via the coolant return passageway back to the external cooling unit where it is cooled before reentering the coolant injection assembly and repeating the cycle. Because of the surface area augmentation employed in the cooling system of the present invention, heat is conducted away from the x-ray tube in a substantially more efficient manner than would otherwise be the case. This increased rate of heat transfer prolongs the life of the x-ray device and allows for greater operational flexibility. Further, the use of an impinging coolant flow in conjunction with the flow diverter results in highly efficient convective cooling of the anode and other x-ray tube structures.

These and other objects and features of the present claimed invention will become more fully apparent from the following description and appended claims, or may be learned by the practice of the invention as set forth hereinafter.

BRIEF DESCRIPTION OF THE DRAWINGS

In order that the manner in which the above recited and other advantages and features of the claimed invention are obtained, a more particular description of the claimed invention briefly described above will be rendered by reference to specific embodiments thereof, which are illustrated in the appended drawings. Understanding that these drawings depict only typical embodiments of the invention as claimed and are not therefore to be considered limiting of its scope, the claimed invention will be described and explained with additional specificity and detail through the use of the accompanying drawings in which:

DETAILED DESCRIPTION OF THE PREFERRED EMBODIMENTS

Reference will now be made to figures wherein like structures will be provided with like reference designations. It is to be understood that the drawings are diagrammatic and schematic representations of various embodiments of the claimed invention, and are not to be construed as limiting the present claimed invention, nor are the drawings necessarily drawn to scale.

Figures 1, 2:
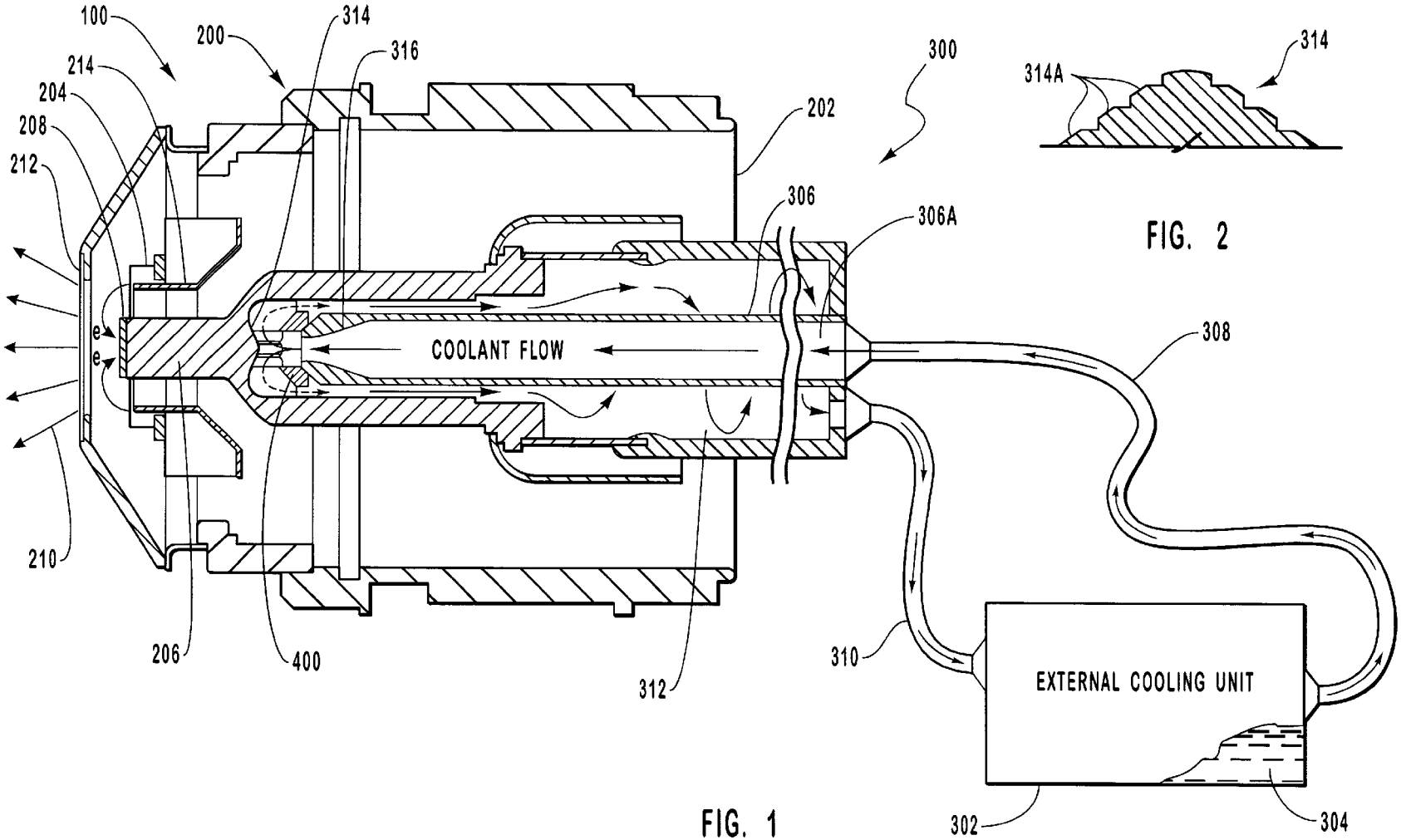
FIG. 1 is a cutaway view of an embodiment of a stationary anode x-ray generating device indicating various details of an embodiment of a surface area augmentation structure, and its relation to the other elements of the cooling system.
FIG. 2 is a cross-section view of one embodiment of a flow diverter.

Referring first to FIG. 1, an x-ray device is depicted generally at 100. In a preferred embodiment, x-ray device 100 comprises a stationary anode configuration and includes an x-ray tube 200 and a x-ray tube x-ray tube cooling system 300. Additionally, x-ray tube cooling system 300 includes a surface area augmentation structure 400. X-ray tube 200 includes a vacuum enclosure 202, inside of which are disposed in close proximity to each other an electron source 204 and a fixed anode 206. Disposed at the target end of fixed anode 206 is a target surface 208, which preferably comprises an element with a high "Z" number, such as tungsten or the like Fixed anode 206 is formed of a material with a high thermal conductivity, preferably copper or copper alloys. The high thermal conductivity of fixed anode 206 facilitates dissipation of at least some of the heat produced at target surface 208 resulting from the interactions between electrons "e" and target surface 208.

In operation, an electrical current is supplied to electron source 204, which causes a beam of electrons "e" to be emitted from electron source 204 by way of thermionic emission. A potential difference is applied between electron source 204 and fixed anode 206, which causes electrons "e" to accelerate to a high velocity. As a consequence of their high velocity, electrons "e" possess a relatively large amount of kinetic energy as they travel toward target surface 208. Electrons "e" then impinge upon target surface 208, whereupon a portion of their kinetic energy is converted to x-rays, schematically represented at 210, which are then directed through a window 212 of x-ray tube 200, and ultimately into an x-ray subject. A shield 214 within vacuum enclosure 202 substantially prevents errant electrons from impacting fixed anode 206 other than at target surface 208.

Directing continuing attention to FIG. 1, additional details regarding the structure and components of x-ray tube cooling system 300 are provided. In particular, x-ray tube cooling system 300 includes an external cooling unit 302 containing a volume of coolant 304. One embodiment of external cooling unit 302 comprises a reservoir, a fluid pump, and a heat exchanger device, or the like, configured to work in concert to continuously circulate coolant 304 through fixed anode 206 so as to remove heat from fixed anode 206 and other structures of x-ray device 100. Note that heat exchange devices such as external cooling unit 302 are well known in the art. Accordingly, it will be appreciated that a variety of other heat exchange devices and/or components may be employed to provide the functionality of external cooling unit 302, as disclosed herein.

In a preferred embodiment, coolant 304 comprises a dielectric oil such as, but not limited to, Shell Diala Oil AX and Syltherm 800. However, it will be appreciated that coolant 304 could alternatively comprise deionized water or any other appropriate coolant that is capable of performing the functions of coolant 304, as enumerated herein. Note that, as contemplated herein, "coolant" includes, but is not limited to, both liquid and dual phase coolants.

With continuing reference to FIG. 1, external cooling unit 302 communicates with a coolant supply passageway 306A, defined by coolant injection assembly 306, by way of fluid conduit 308. Note that the functionality provided by fluid conduits 308 and 310 (discussed below) may achieved with any of a variety of components or devices including, but not limited to, hoses, tubing, pipe, or the like.

Coolant injection assembly 306 is disposed, preferably removably, in a cavity defined by fixed anode 206 and thus cooperates with fixed anode 206 to define coolant return passageway 312. A flow diverter 314, preferably integral with fixed anode 206, further serves to facilitate the definition of coolant return passageway 312. As discussed in greater detail below, a nozzle 316 in fluid communication with coolant supply passageway 306A causes coolant 304 to accelerate after it exits coolant supply passageway 306A. Note that in a preferred embodiment, nozzle 316 is integral with coolant injection assembly 306.

Surface area augmentation structure 400 is preferably interposed between nozzle 316 and flow diverter 314 so that, as suggested by the flow arrows in FIG. 1, coolant 304 leaving coolant supply passageway 306A passes through surface area augmentation structure 400 and is then directed into coolant return passageway 312 by flow diverter 314. Coolant 304 entering coolant return passageway 312 ultimately returns to external cooling unit 302 by way of fluid conduit 310. Note that in a preferred embodiment, coolant return passageway 312 is substantially concentric with, and disposed about, coolant supply passageway 306A. However, it will be appreciated that various other configurations may be employed to provide the functionality disclosed herein.

It will be appreciated that, while a preferred embodiment comprises a single coolant supply passageway 306A and a single coolant return passageway 312, multiple coolant supply passageways and/or coolant return passageways may be employed so as to suit a particular application and/or to achieve a desired cooling effect. Such arrangements are accordingly contemplated as being within the scope of the present invention.

Directing continuing attention to FIG. 1, the operation of x-ray tube cooling system 300 proceeds generally as follows. External cooling unit 302 directs a flow of coolant 304 into coolant supply passageway 306A by way of fluid conduit 308. Coolant 304 flows through coolant supply passageway 306A and proceeds to nozzle 316.

As previously noted, nozzle 316 causes the flowing coolant 304 to accelerate as it passes therethrough. In general, the velocity of a fluid flow is at least partially a function of the cross-sectional area of the passageway through which the fluid flows. Thus, for a constant rate of flow, the velocity of the fluid increases as the cross-sectional area of the passageway decreases. Further, it is well known that accelerating a flow of coolant and then impinging the accelerated coolant on the surface(s) to be cooled (as discussed below) is a highly efficient method of convective cooling. This process is often referred to as "impinging flow heat transfer" or "jet impingement heat transfer." It will be appreciated that the acceleration of coolant 304 produced by the geometry of nozzle 316 desirably contributes to the relatively high rates of heat transfer achieved with embodiments of the present invention.

It will accordingly be appreciated that the available flow area, rate of convergence, or other geometric features of nozzle 316 may be varied as required to suit a particular application and/or to achieve a desired cooling effect. It will likewise be appreciated that the acceleration imparted to coolant 304 by nozzle 316 may be achieved by a variety of other devices and/or structures. Accordingly, such other devices and structures are contemplated as being within the scope of the present invention.

Finally, note that nozzle 316 is but one example of a means for accelerating coolant 304. Accordingly, the structure disclosed herein simply represents one embodiment of structure capable of performing this function. It should be understood that this structure is presented solely by way of example and should not be construed as limiting the scope of the present invention in any way.

As coolant 304 exits nozzle 316, it passes through an aperture 404 defined by surface area augmentation structure 400. As discussed in greater detail below, surface area augmentation structure 400 comprises a material of high thermal conductivity and is in substantial contact with fixed anode 206 so that at least some of the heat present in fixed anode 206 is transmitted to surface area augmentation structure 400, and thence to coolant 304 passing through surface area augmentation structure 400.

After passing through surface area augmentation structure 400 and absorbing heat therefrom, coolant 304 then impinges upon flow diverter 314 which redirects the flow of coolant 304 so that it comes into contact with extended surfaces (discussed below) disposed on surface area augmentation structure 400. Because flow diverter 314 is, preferably, integral with fixed anode 206, heat is transmitted from fixed anode 206 to flow diverter 314 and coolant 304 thus absorbs heat both from flow diverter 314 as well as from surface area augmentation structure 400.

As suggested above, flow diverter 314 is preferably integral with fixed anode 206. However, it will be appreciated that flow diverter 314 may be manufactured separately and subsequently attached, by brazing, welding, or other processes, to fixed anode 206. Further, while flow diverter 314 is substantially conical in cross-section, it will be appreciated that various other shapes and/or combinations thereof may be employed to achieve a particular effect or result, and/or to suit various geometries of surface area augmentation structure 400.

Finally, one embodiment of flow diverter 314, depicted in FIG. 2, includes surface area augmentation so as to facilitate improved heat transfer from fixed anode 206 to coolant 304. In the illustrated embodiment, the surface area augmentation of flow diverter 314 takes the form of a plurality of annular grooves or the like, cut or formed into the surface of flow diverter 314 so as to provide for a relative increase in the surface area thereof by, for example, collectively defining a plurality of extended surfaces 314A. In one alternative embodiment, such surface area augmentation may take the form of a plurality of extended surfaces disposed on flow diverter 314—wherein the extended surfaces may be either formed integrally, or formed separately from flow diverter 314 and subsequently attached thereto. In another alternative embodiment, the surface area augmentation of flow diverter 314 takes the form of a plurality of axial grooves generally aligned with the path of coolant 304 passing over flow diverter 314.

After passing through surface area augmentation structure 400, coolant 304 then proceeds into coolant return passageway 312 and returns to external cooling unit 302, by way of fluid outlet conduit 310, where it is cooled and returned to coolant injection assembly 306 to repeat the cycle.

Figure 5:
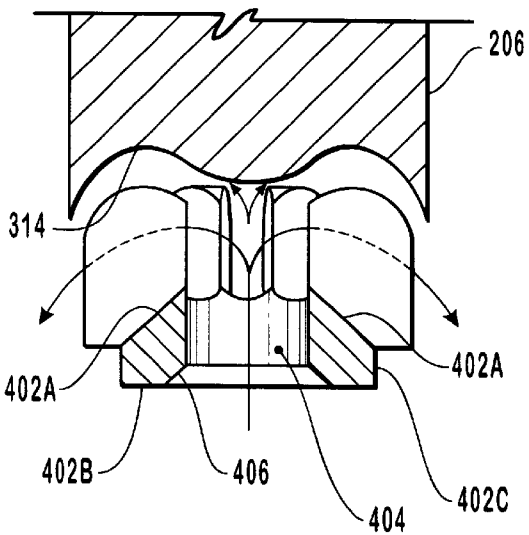
FIG. 5 is a cutaway view of the surface area augmentation structure, taken along line 5—5 of FIG. 4, depicting additional detail of the surface area augmentation structure.
Figure 4:
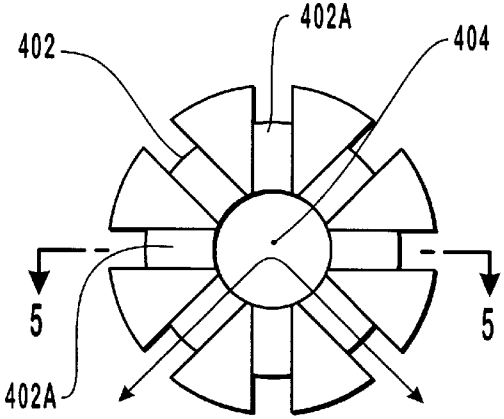
FIG. 4 is a top view of the surface area augmentation structure of FIG. 3, depicting one embodiment of a cooling fin arrangement.
Figure 3:
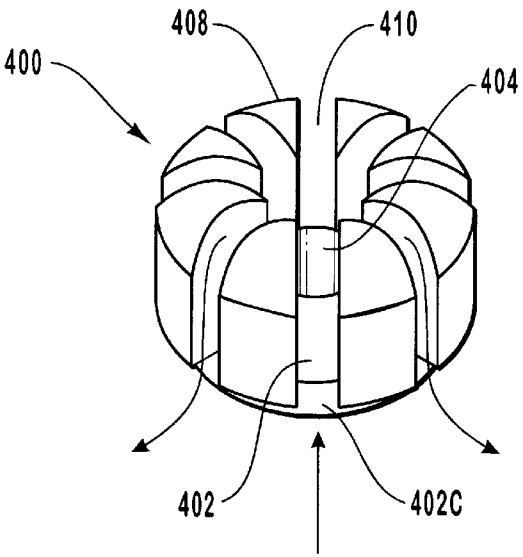
FIG. 3 is a perspective view of an embodiment of the surface area augmentation structure, depicting the flow of cooling fluid with respect to the surface area augmentation structure.

Directing attention now to FIGS. 3, 4, and 5 together, additional details regarding various features of surface area augmentation structure 400 are provided. A preferred embodiment of surface area augmentation structure 400 comprises an annular body 402 defining an aperture 404 therethrough and including a top surface 402A, a bottom surface 402B, and a side surface 402C. Preferably, aperture 404 is concentric with annular body 402. Finally, surface area augmentation structure 400 defines a countersink 406, preferably concentric with aperture 404.

It will be appreciated that surface area augmentation structure 400 and/or its constituent elements may be configured in a virtually unlimited number of ways. In general however, any device or structure which serves to provide a relative increase in the surface area, inside the cavity partially defined by fixed anode 206, with which coolant 304 comes into contact, is contemplated as being within the scope of the present invention. As previously discussed, surface area augmentation structure 400 may be used alone or in conjunction with various other extended surfaces, an embodiment of which is indicated in FIG. 2.

It will further be appreciated that a variety of means may be profitably employed to perform the functions, enumerated herein, of surface area augmentation structure 400. Surface area augmentation structure 400 is but one example of a means for transferring heat from fixed anode 206 to coolant 304. Accordingly, the structure disclosed herein simply represents one embodiment of structure capable of performing this function. It should be understood that this structure is presented solely by way of example and should not be construed as limiting the scope of the present invention in any way.

With continuing reference to FIGS. 3, 4, and 5, surface area augmentation structure 400 also includes a plurality of extended surfaces 408, preferably cooling fins, disposed about annular body 402 and cooperatively defining a plurality of flow slots 410. In a preferred embodiment, extended surfaces 408 are equally spaced about annular body 402. However, it will be appreciated that variables including, but not limited to, the size, shape, number, and spacing of extended surfaces 408 may be varied either alone, or in various combinations, so as to suit various applications and/or to achieve one or more desired cooling effects. For example, extended surfaces 408 may alternatively comprise one or more annular rings disposed about annular body 402 and broken at periodic intervals by gaps so as to allow coolant to flow from aperture 404 across the annular rings, and then to coolant return passageway 312 (see FIG. 1).

As suggested earlier, surface area augmentation structure 400 is formed from a material having a high thermal conductivity such as, but not limited to, copper or copper alloys. Methods of manufacture of surface area augmentation structure 400 may include molding, machining, casting, forging, or the like. Additionally, it will be appreciated that surface area augmentation structure 400 may be formed as an integral piece, or as an assembly comprising two or more separate components. In any event, surface area augmentation structure 400 is preferably so formed as to be readily insertable into fixed anode 206 without requiring substantial modification thereto.

Returning briefly to FIG. 1, surface area augmentation structure 400 is preferably disposed in fixed anode 206 so as to be interposed between flow diverter 314 and nozzle 316 of coolant injection assembly 306. In general, surface area augmentation structure 400 is disposed and oriented so as to receive at least some heat from fixed anode 206 and to transmit at least a portion of that heat to coolant 304. In particular, countersink 406 (see FIG. 5) of surface area augmentation structure 400 is configured to receive nozzle 316 so as to ensure proper alignment of coolant supply passageway 306A and nozzle 316 with surface area augmentation structure 400. Further, the uppermost portions of extended surfaces 408 are preferably shaped to correspond, at least generally, with the geometric configuration of flow diverter 314. This arrangement ensures alignment of surface area augmentation structure 400 with flow diverter 314, and thus, substantial and efficient contact between flow diverter 314, surface area augmentation structure 400, and coolant 304.

It will be appreciated that surface area augmentation structure 400 may be emplaced in a variety of different ways. For example, surface area augmentation structure 400 may be attached to nozzle 316 by various processes including, but not limited to, welding, brazing, or the like. Alternatively, surface area augmentation structure 400 may be welded or brazed inside fixed anode 206. In yet another alternative embodiment, surface area augmentation structure 400 may be removably attached to nozzle 316, for example by pins or other devices well known in the art. Such an interchangeability feature permits ready removal and replacement of surface area augmentation structure 400. This would be desirable in those instances where it was desired to test the performance of various embodiments of surface area augmentation structure 400 and/or to employ a particular surface area augmentation structure 400 calculated to produce a desired cooling effect.

With continuing reference now to FIGS. 3, 4, and 5, various details regarding the operation of surface area augmentation structure 400 in the context of x-ray tube cooling system 300 are provided. In particular, coolant 304 exiting nozzle 316 enters surface area augmentation structure 400 by way of aperture 404 and impinges upon flow diverter 314.

As noted earlier, one function of flow diverter 314 is to transfer at least some heat from fixed anode 206 to coolant 304. However, flow diverter 314 also possesses certain geometric attributes which further enhance the cooling process. In particular, by virtue of its conical geometry, flow diverter 314 serves to direct the flow of coolant 304, not back upon itself but rather, outwardly through slots 412 cooperatively defined by extended surfaces 408, and ultimately to coolant return passageway 312. Thus, coolant 304 comes into substantial contact with extended surfaces 408 of surface area augmentation structure 400 and removes at least a portion of the heat thereof.

As is well known, the rate of heat transfer is at least partially a function of the surface area across which it is desired to transfer the heat. Thus, the increased surface area achieved through the employment of surface area augmentation structure 400 provides for a relative increase in heat transfer from fixed anode 206 to coolant 304. It will be appreciated that such variables as, but not limited to, the flowrate, and pressure of coolant 304 may be varied as required to suit a particular application and/or to achieve one or more desired cooling effects.

To briefly summarize, x-ray tube cooling system 300 possesses a variety of features which facilitate achievement of relatively higher rates of heat transfer in x-ray tube devices than would otherwise be possible. These features include, but are not limited to, a coolant injection assembly configured for jet impingement heat transfer, extended surfaces disposed within the anode and in substantial contact with coolant flowing through the anode, and surface area augmentation structures disposed within the anode to provide for a relative increase in heat transfer from the anode to the coolant.

The improved rate of heat transfer achieved by embodiments of cooling system 300 has number of desirable consequences. For example, increased heat removal from x-ray device 100 equates to an extension of its operating lifetime because of the reduced chances for heat-related failure of x-ray tube components. Also, because less heat remains in the x-ray tube during operation, x-ray device 100 can operate at a lower temperature for a given power setting, or inversely, x-ray device 100 may be operated at a somewhat higher power setting without materially increasing the overall operating temperature.

The present claimed invention may be embodied in other specific forms without departing from its spirit or essential characteristics. The described embodiments are to be considered in all respects only as illustrative, not restrictive. The scope of the claimed invention is, therefore, indicated by the appended claims rather than by the foregoing description. All changes that come within the meaning and range of equivalency of the claims are to be embraced within their scope.

What is claimed and desired to be secured by United States Letters Patent is:

1. An x-ray tube comprising:

(a) a vacuum enclosure having an electron source and anode disposed therein, said anode having a target surface positioned to receive electrons emitted by said electron source, and said anode at least partially defining at least one fluid passageway wherein said at least one fluid passageway allows a flow of coolant to contact at least a portion of said anode;

(b) at least one surface area augmentation structure disposed within said at least one fluid passageway, at least a portion of heat generated in said anode being transmitted to said at least one surface area augmentation structure, and said flow of coolant absorbing at least a portion of heat from said at least one surface area augmentation structure as said flow of coolant passes through said at least one fluid passageway; and (c) means for accelerating said coolant so as to facilitate jet impingement heat transfer from at least a portion of said anode to said coolant.

2. The x-ray tube of claim 1, wherein said at least one surface area augmentation structure comprises a plurality of extended surfaces arranged to be in substantial contact with said coolant as said coolant passes through said at least one fluid passageway.

3. The x-ray tube of claim 1, wherein said at least one surface area augmentation structure substantially comprises copper.

4. The x-ray tube of claim 1, wherein said coolant is dielectric.

5. The x-ray tube of claim 1, further comprising a flow diverter disposed proximate to said at least one surface area augmentation structure and directing said coolant into substantial contact with said at least one surface area augmentation structure after said coolant exits said at least one fluid passageway.

6. The x-ray tube of claim 1, wherein said anode comprises at least one extended surface in substantial contact with said coolant as said coolant flows through said at least one fluid passageway, said at least one extended surface facilitating transfer of heat from said anode to said coolant.

7. The x-ray tube of claim 6, wherein said at least one extended surface is integral with said anode.

8. The x-ray tube as recited in claim 1, wherein said anode is substantially stationary with respect to said electron source.

9. The x-ray tube as recited in claim 1, wherein said means for accelerating coolant comprises a nozzle through which at least a portion of said flow of coolant passes prior to entry into said at least one fluid passageway.

10. The x-ray tube as recited in claim 9, wherein said nozzle defines at least two different diameters.

11. The x-ray tube as recited in claim 9, wherein said surface area augmentation structure is located downstream of said nozzle.

12. The x-ray tube as recited in claim 1, wherein said at least one surface area augmentation structure comprises a cooling disk.

13. The x-ray tube as recited in claim 1, wherein said at least one surface area augmentation structure defines an aperture through which at least some coolant passes.

14. An x-ray tube comprising:

(a) a vacuum enclosure having an electron source and stationary anode disposed therein, said stationary anode having a target surface positioned to receive electrons emitted by said electron source, and said stationary anode at least partially defining at least one fluid passageway wherein said at least one fluid passageway allows a flow of coolant to contact at least a portion of said stationary anode;

(b) means for accelerating said coolant so as to facilitate jet impingement heat transfer from at least a portion of said stationary anode to said coolant; and (c) means for transferring heat from said stationary anode to said coolant.

15. The x-ray tube of claim 14, wherein said means for accelerating coolant comprises a nozzle through which coolant passes prior to entry into said at least one fluid passageway, said nozzle causing said coolant to accelerate as it passes therethrough.

16. The x-ray tube of claim 14, wherein said means for transferring heat from said anode to said coolant comprises at least one surface area augmentation structure disposed within said at least one fluid passageway, at least a portion of heat present in said stationary anode being transmitted to said at least one surface area augmentation structure, and said flow of coolant absorbing at least a portion of heat from said at least one surface area augmentation structure as said flow of cooling fluid passes through said at least one fluid passageway.

17. The x-ray tube of claim 16, wherein said surface area augmentation structure comprises a cooling disk having disposed thereon at least one extended surface, said cooling disk being disposed within said at least one fluid passageway, and said cooling disk being in substantial contact with said flow of coolant so that at least a portion of heat present in said stationary anode is transmitted to said cooling disk and said flow of coolant absorbs at least a portion of heat from said cooling disk as said flow of coolant passes through said at least one fluid passageway.

18. The x-ray tube as recited in claim 16, wherein said means for accelerating said coolant directs at least a portion of said coolant flow at said at least one surface area augmentation structure.

19. The x-ray tube as recited in claim 14, further comprising a flow diverter arranged for contact with said accelerated coolant.

20. The x-ray tube as recited in claim 14, wherein said stationary anode comprises at least one extended surface arranged for contact with said coolant.

21. The x-ray tube as recited in claim 14, wherein said means for transferring heat from said stationary anode to said coolant comprises a cooling disk.

22. The x-ray tube as recited in claim 21, wherein said cooling disk is disposed within said at least one fluid passageway.

23. An x-ray tube cooling system for use in conjunction with an x-ray tube having a stationary anode, the x-ray tube cooling system comprising:

(a) an at least one fluid passageway disposed proximate to the stationary anode so that a flow of coolant passing through said at least one fluid passageway absorbs at least some heat from the stationary anode;

(b) an external cooling unit, said external cooling unit circulating said flow of coolant through said at least one fluid passageway; and (c) at least one surface area augmentation structure disposed substantially within said at least one fluid passageway so that at least a portion of heat generated in the stationary anode is transmitted to said coolant as said coolant flows over said at least one surface area augmentation structure.

24. The x-ray tube cooling system of claim 23, further comprising a flow diverter in substantial contact with said stationary anode and said coolant so that at least some heat present in said stationary anode is transmitted to said coolant by way of said flow diverter, said flow diverter directing said coolant into substantial contact with said at least one surface area augmentation structure after said coolant exits said at least one fluid passageway.

25. The x-ray tube cooling system of claim 24, wherein said flow diverter further comprises at least one extended surface in substantial contact with said coolant.

26. The x-ray tube cooling system of claim 23, further comprising a nozzle in fluid communication with said at least one fluid passageway, said nozzle causing coolant passing therethrough to accelerate before contacting said at least one surface area augmentation structure.

27. The x-ray tube cooling system of claim 23, wherein said at least one surface area augmentation structure comprises a plurality of extended surfaces disposed in said at least one fluid passageway so as to be in substantial contact with coolant flowing therethrough.

28. The x-ray tube cooling system of claim 23, wherein said coolant is substantially dielectric.

29. The x-ray tube cooling system as recited in claim 23, further comprising means for accelerating said coolant so as to facilitate jet impingement heat transfer from at least a portion of said stationary anode to said coolant.

30. The x-ray tube cooling system as recited in claim 23, wherein said at least one surface area augmentation structure comprises a cooling disk.

31. The x-ray tube cooling system as recited in claim 23, wherein said at least one surface area augmentation structure defines an aperture through which at least some coolant flows.

32. The x-ray tube cooling system as recited in claim 23, wherein said at least one surface area augmentation structure comprises a plurality of extended surfaces.

33. In a stationary anode x-ray tube comprising a vacuum enclosure having an electron source and stationary anode disposed therein, the stationary anode having a target surface positioned to receive electrons emitted by the electron source, and the stationary anode at least partially defining at least one fluid passageway through which a coolant flows, a cooling disk disposed within the at least one fluid passageway and being in substantial contact with the stationary anode and the coolant flowing through the at least one fluid passageway so as to transfer at least some heat from the stationary anode to the coolant, the cooling disk comprising:

(a) a body defining an aperture therethrough; and (b) at least one extended surface disposed on said body.

34. The cooling disk of claim 33, wherein said at least one extended surface comprises a plurality of extended surfaces disposed on said body.

35. The cooling disk of claim 34, wherein said plurality of extended surfaces collectively define a plurality of cooling slots in fluid communication with said aperture so that at least some coolant flowing through said aperture exits said cooling disk by way of said slots.

36. The cooling disk of claim 34, wherein said plurality of extended surfaces is integral with said body.

37. The cooling disk of claim 33, wherein said cooling disk substantially comprises copper.

38. The cooling disk of claim 33, wherein said at least one extended surfaces comprises at least one annular fin, said at least one annular fin being substantially concentric with said aperture.

39. An x-ray tube comprising:

(a) a vacuum enclosure having an electron source and an anode disposed therein, said anode having a target surface positioned to receive electrons emitted by said electron source, and said anode at least partially defining at least one fluid passageway; and (b) a cooling disk substantially disposed within said at least one fluid passageway and arranged for contact with coolant disposed in said at least one fluid passageway.

40. The x-ray tube as recited in claim 39, further comprising a means for accelerating said coolant in order to facilitate jet impingement heat transfer from at least a portion of said anode to said coolant.

41. The x-ray tube as recited in claim 39, further comprising a nozzle in fluid communication with said at least one fluid passageway, said nozzle defining at least two different diameters.

42. The x-ray tube as recited in claim 39, wherein said anode comprises at least one extended surface arranged for substantial contact with said coolant.

43. The x-ray tube as recited in claim 39, wherein said cooling disk defines an aperture through which at least some coolant flows.

44. The x-ray tube as recited in claim 39, wherein said cooling disk comprises at least one extended surface arranged for contact with said coolant.

45. The x-ray tube as recited in claim 39, wherein said anode is substantially stationary with respect to said electron source.

46. The x-ray tube as recited in claim 39, further comprising a flow diverter arranged for contact with said coolant.

47. A cooling system suitable for use in conjunction with an x-ray tube that includes a stationary anode, the cooling system comprising:

(a) an external cooling unit including a volume of coolant;

(b) a fluid passageway disposed proximate the stationary anode and in fluid communication with said external cooling unit;

(c) a nozzle in fluid communication with said fluid passageway, said nozzle defining at least two different diameters;

(d) a surface area augmentation structure disposed within said fluid passageway; and (e) a flow diverter, said flow diverter arranged so that said surface area augmentation structure is interposed between said flow diverter and said nozzle.

48. The cooling system as recited in claim 47, wherein said surface area on structure comprises a cooling disk.

49. In an x-ray device including a vacuum enclosure having an electron source and an anode substantially disposed therein, the anode including a target surface positioned to receive electrons emitted by the electron source, a method for cooling at least a portion of the x-ray device, the method comprising:

(a) providing a flow of coolant;

(b) accelerating at least a portion of said flow of coolant; and (c) directing at least some accelerated coolant into contact with at least a portion of the x-ray device wherein acceleration of said coolant facilitates jet impingement heat transfer from said at least a portion of the x-ray device to said coolant.

50. The method as recited in claim 49, further comprising removing at least some heat from said coolant after said coolant has contacted said at least a portion of the x-ray device.

51. An x-ray tube comprising:

(a) a vacuum enclosure having an electron source and anode disposed therein, said anode having a target surface positioned to receive electrons emitted by said electron source, and said anode at least partially defining at least one fluid passageway configured to permit a coolant to contact at least a portion of said anode; and (b) means for accelerating said coolant so as to facilitate jet impingement heat transfer from at least a portion of the x-ray tube to at least some of said coolant.

52. The x-ray tube as recited in claim 51, wherein said means for accelerating said coolant directs at least some of said coolant into contact with said anode.

53. The x-ray tube as recited in claim 51, further comprising a surface area augmentation structure substantially disposed within said at least one fluid passageway.

54. The x-ray tube as recited in claim 51, wherein said means for accelerating said coolant comprises a nozzle in fluid communication with said at least one fluid passageway.

55. The x-ray tube as recited in claim 51, wherein said anode is substantially stationary with respect to said electron source.

* * * * *

UNITED STATES PATENT AND TRADEMARK OFFICE

CERTIFICATE OF CORRECTION

PATENT NO. : 6,580,780 B1
DATED : June 17, 2003
INVENTOR(S) : Robert S. Miller

It is certified that error appears in the above-identified patent and that said Letters Patent is hereby corrected as shown below:

Column 4,
Line 44, before “x-ray” change “a” to -- an --
Line 44, before “cooling” delete “x-ray tube”
Line 52, after “like” insert a period Column 5,
Line 33, before “achieved” insert -- be --

Column 9,
Line 28, before “number” insert -- a --

Column 13,
Line 25, before “structure” change “on” to -- augmentation --

Signed and Sealed this

Ninth Day of December, 2003

JAMES E. ROGAN
*Director of the United States Patent and Trademark Office*